US010702996B2

(12) United States Patent
Su

(10) Patent No.: US 10,702,996 B2
(45) Date of Patent: Jul. 7, 2020

(54) CONVENIENT BLADE CHANGEABLE KNIFE

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 0 days.

(21) Appl. No.: 16/261,762

(22) Filed: Jan. 30, 2019

(65) Prior Publication Data

US 2019/0232507 A1 Aug. 1, 2019

(30) Foreign Application Priority Data

Jan. 31, 2018 (TW) ..... 107103478 A

(51) Int. Cl.
*B26B 5/00* (2006.01)

(52) U.S. Cl.
CPC ..... *B26B 5/00* (2013.01); *B26B 5/006* (2013.01)

(58) Field of Classification Search
CPC ..... B26B 5/00; B26B 5/006
USPC ..... 30/329, 337, 339
See application file for complete search history.

(56) References Cited

U.S. PATENT DOCUMENTS 2,605,545 A * 8/1952 Weems ..... B26B 5/00 30/337
4,575,936 A * 3/1986 Gringer ..... B25G 3/28 279/39
5,056,226 A * 10/1991 Gringer ..... B26B 5/00 30/169
5,996,231 A * 12/1999 Roche ..... B26B 5/006 30/169
6,715,210 B2 * 4/2004 Chao ..... B44D 3/162 30/169
7,814,608 B1 * 10/2010 Catello ..... A47L 13/022 15/236.01
8,291,598 B2 10/2012 Corron et al.
8,356,415 B2 1/2013 Lin
8,567,069 B2 * 10/2013 Robinson ..... B26B 5/00 30/155

(Continued)

FOREIGN PATENT DOCUMENTS

TW 200844312 A 11/2008
TW I617406 B 3/2018

*Primary Examiner* — Hwei-Siu C Payer
(74) *Attorney, Agent, or Firm* — Alan D. Kamrath; Karin L. Williams; Mayer & Williams PC

(57) ABSTRACT

A blade changeable knife includes a first holding member having a first holding portion and a first connecting portion and a second holding member having a second holding portion and a second connecting portion. The second holding portion and the second connecting portion is interconnected by a flexible portion. The second connecting portion is disposed on the first connecting portion. The second holding portion and the first holding portion are disposed oppositely. The second holding member is adapted to be flexed to a holding position and a releasing position in which the first and the second holding portions are disposed apart from each other. Further, a lock is movably engaged with the second holding member. The lock is disposed at a first position when the second holding member is in the holding position and at a second position when the second holding member is in the releasing position.

16 Claims, 12 Drawing Sheets

(56) References Cited

U.S. PATENT DOCUMENTS

| | | | | |
|---|---|---|---|---|
| 2002/0096032 | A1* | 7/2002 | Peyrot | B26B 5/00 83/698.11 |
| 2006/0117570 | A1* | 6/2006 | Pool | B26B 5/00 30/162 |
| 2019/0134831 | A1 | 5/2019 | Chiu | |
| 2019/0232507 | A1* | 8/2019 | Su | B26B 5/00 |

* cited by examiner

CONVENIENT BLADE CHANGEABLE KNIFE

BACKGROUND OF THE INVENTION

1. Field of the Invention

The present invention relates to a cutting tool and, particularly, to a knife and, more particularly, to a convenient blade changeable knife.

2. Description of the Related Art

U.S. Pat. No. 8,356,415 B2 entitled scraping tool with blade lock assembly shows a scraping tool for allowing a user to quickly assemble and replace a scraper. The scraping tool includes a gripping portion, a scraping portion, an arm extending from a jaw clamp, and a fastener to be located inside a groove in the back of the scraping section. The fastener is used as a pivot for the arm. The arm can swing back and forth. Further, a control button is operable to force the jaw clamp to frictionally hold a scraper blade.

It is found that the scraping tool has a complex structure. Further, the jaw clamp is not widely open when the scraper blade is replaced, so it is inconvenient to replace the scraper blade. Further, the scraper blade comes off the jaw clamp easily when it is subject to a force that overwhelms the friction therebetween.

The present invention is, therefore, intended to obviate or at least alleviate the problems encountered in the prior art.

SUMMARY OF THE INVENTION

According to the present invention, a convenient blade changeable knife includes a first holding member and a second holding member. The first holding member has a first holding portion and a first connecting portion. The second holding member has a second holding portion and a second connecting portion. The second holding portion and the second connecting portion are interconnected by a flexible portion such that the second holding portion is adapted to be flexed with respect to the second connecting portion. The second connecting portion is disposed on and connected with the first connecting portion. The second holding portion and the first holding portion are disposed oppositely and configured to hold a blade therebetween. The second holding member is adapted to be flexed to a holding position in which the first and the second holding portions are disposed close to each other and include a space therebetween for receiving the blade and a releasing position in which the first and the second holding portions are disposed apart from each other.

The convenient blade changeable knife also includes a locking device having a lock movably engaged with the second holding member. When the second holding member is in the holding position, the lock is disposed on and abuts the second holding member at a first position. When the second holding member is in the releasing position, the lock is disposed on and abuts the second holding member at a second position further away from the second holding portion than when in the first position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
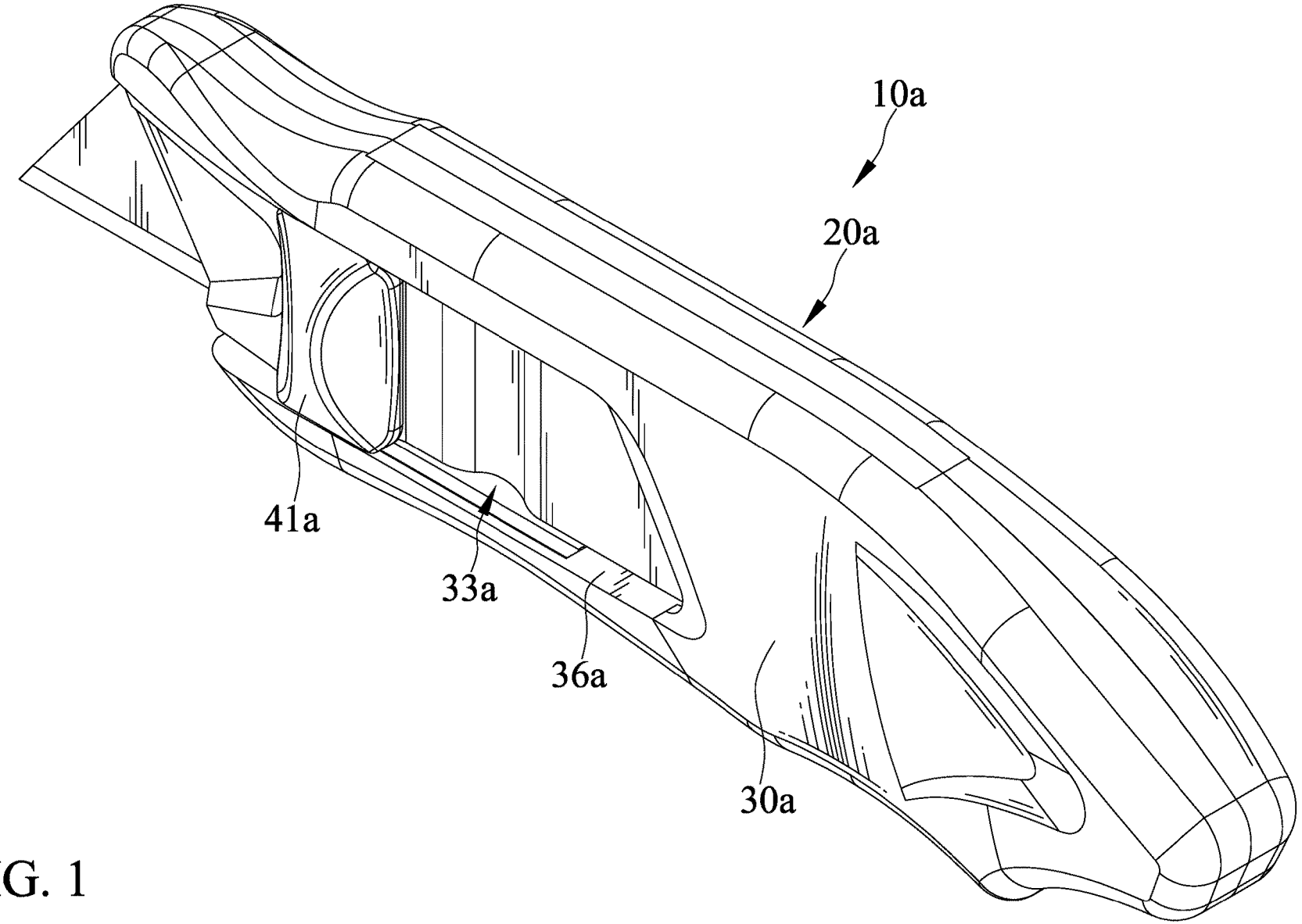
FIG. 1 is a perspective view of a blade changeable knife in accordance with a first embodiment of the present invention.
Figure 2:
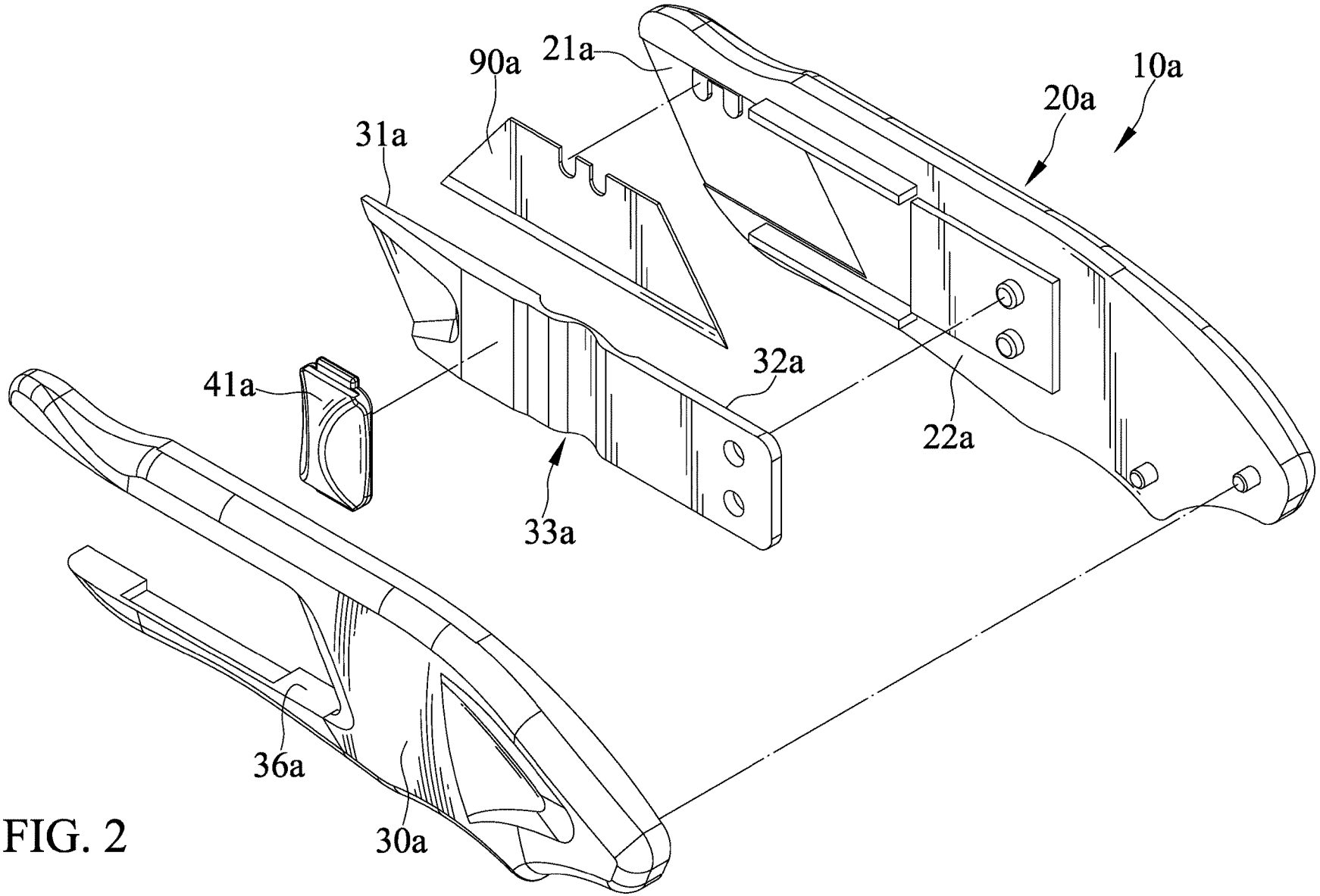
FIG. 2 is an exploded perspective view of the blade changeable knife of FIG. 1.
Figure 3:
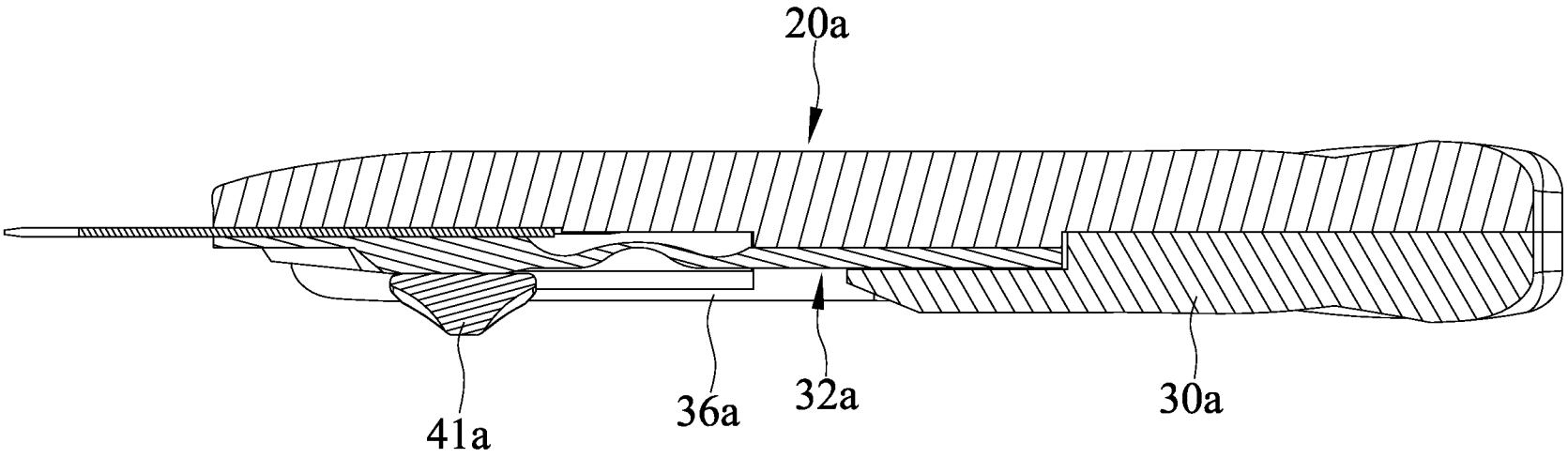
FIG. 3 is a cross-sectional view of the blade changeable knife of FIG. 1 in a blade locked position.
Figure 4:
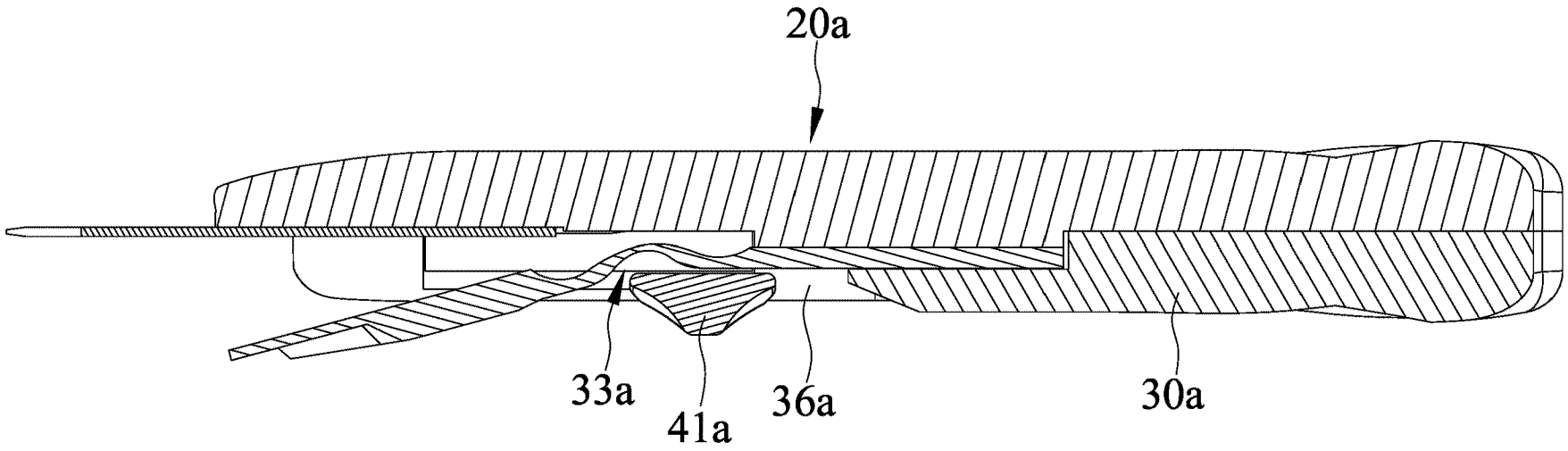
FIG. 4 is a cross-sectional view of the blade changeable knife of FIG. 1 in a blade unlocked position.
Figure 5:
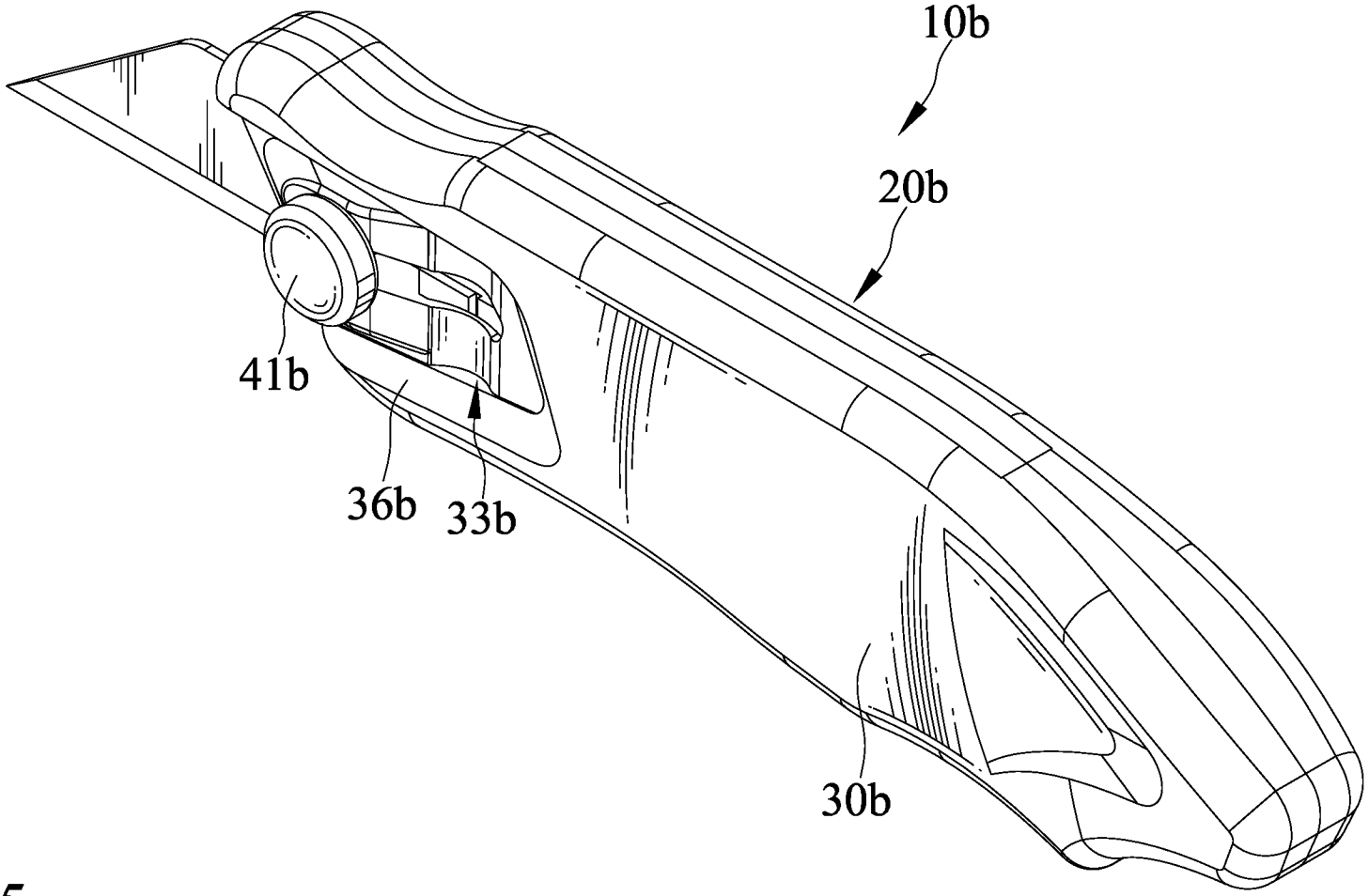
FIG. 5 is a perspective view of a blade changeable knife in accordance with a second embodiment of the present invention.
Figure 6:
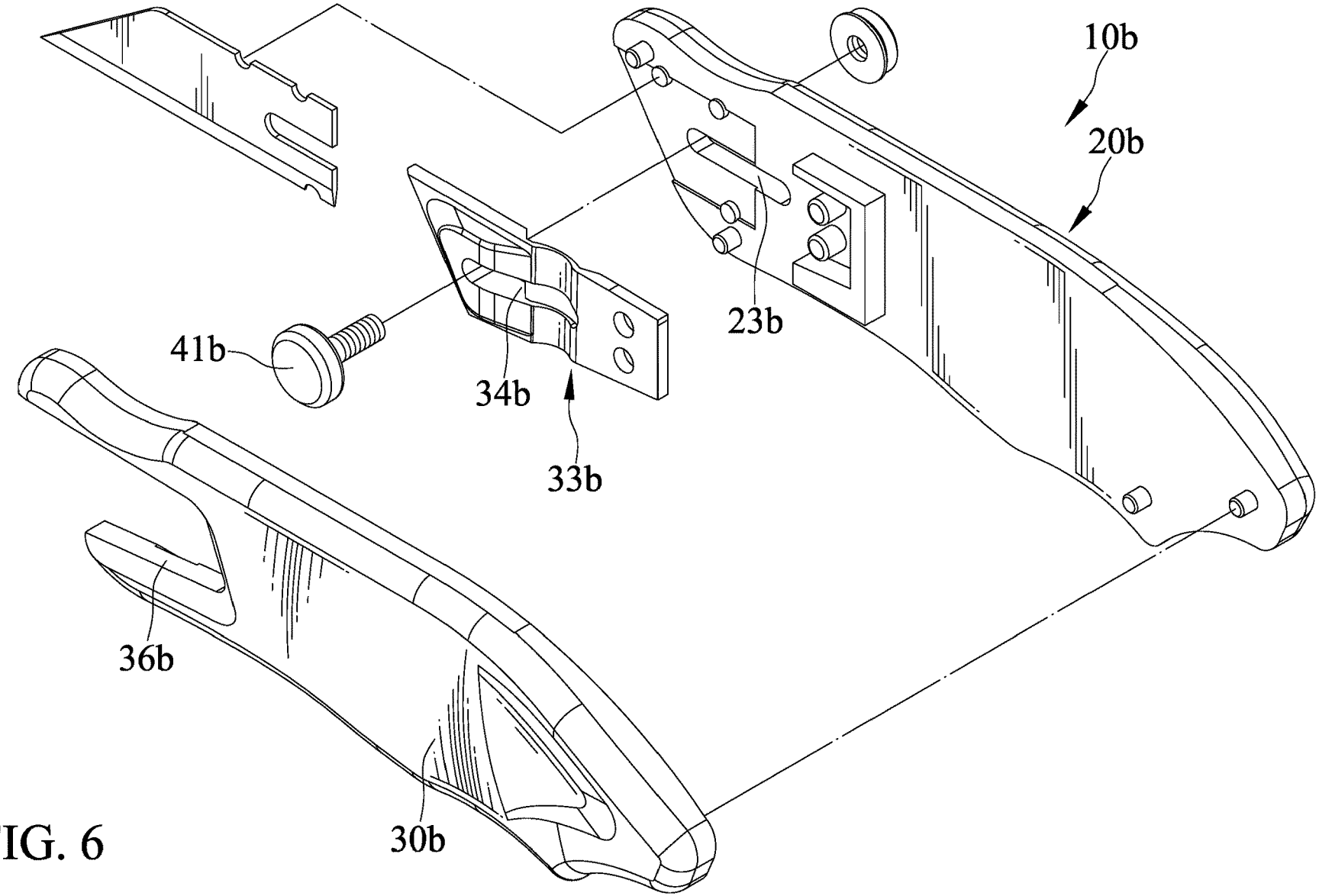
FIG. 6 is an exploded perspective view of the blade changeable knife of FIG. 5.
Figure 7:
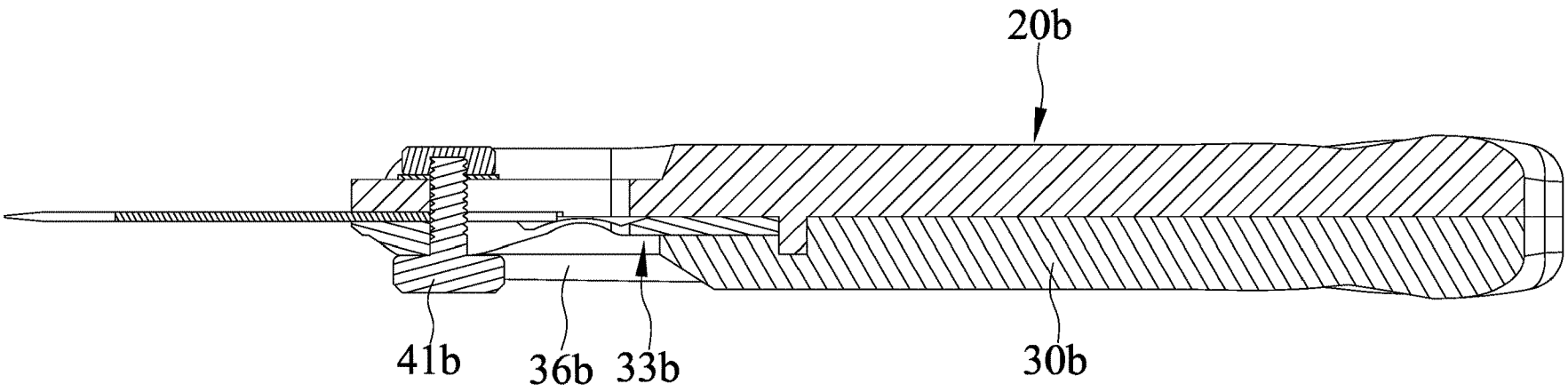
FIG. 7 is a cross-sectional view of the blade changeable knife of FIG. 5 in a blade locked position
Figure 8:
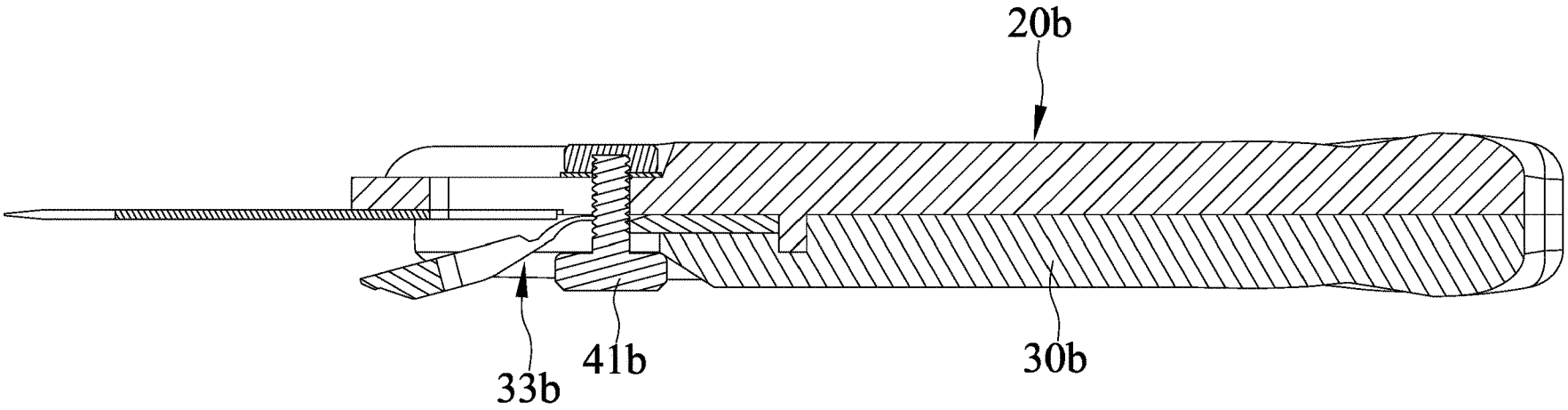
FIG. 8 is a cross-sectional view of the blade changeable knife of FIG. 5 in a blade unlocked position.
Figure 9:
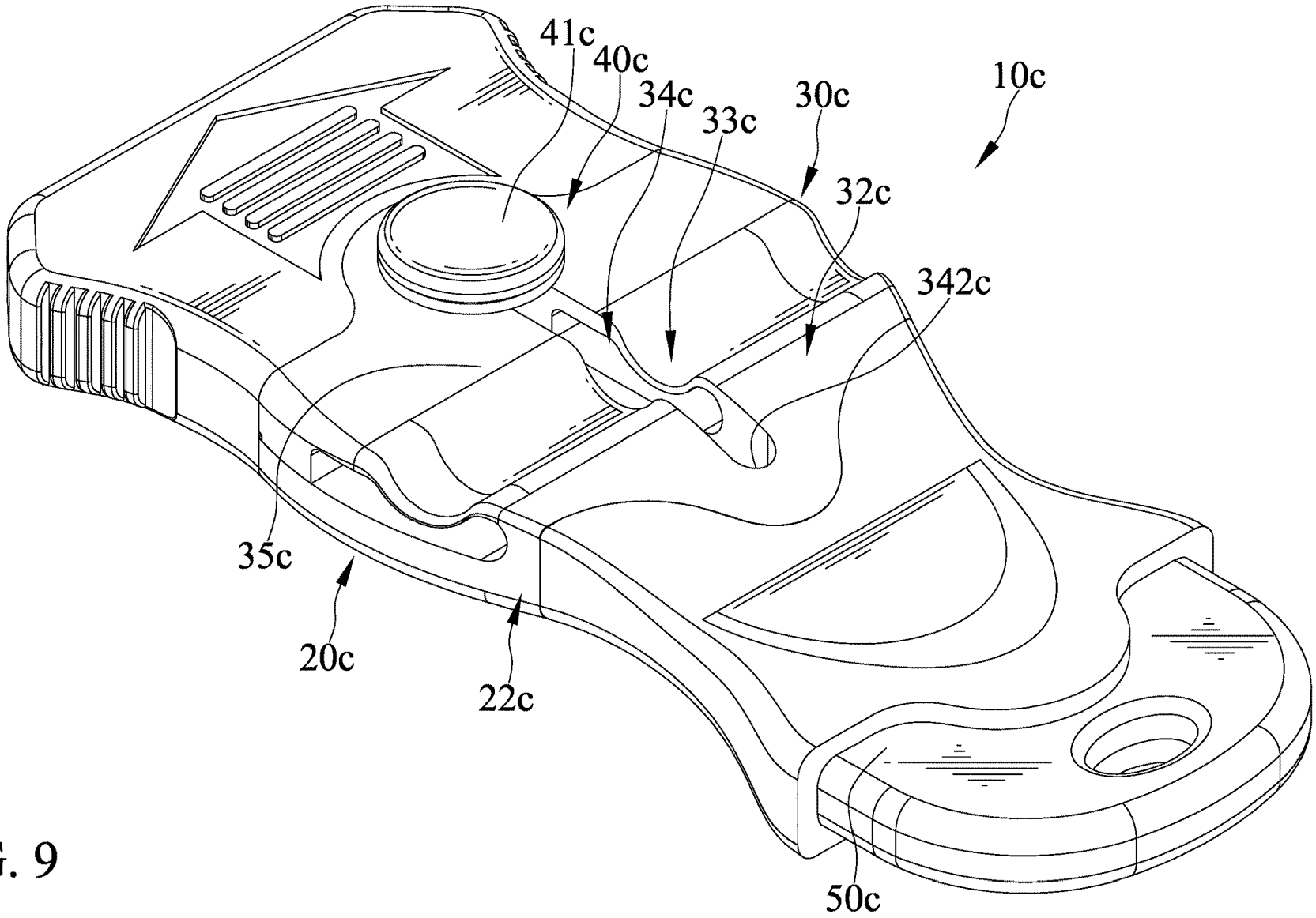
FIG. 9 is a perspective view of a blade changeable knife in accordance with a third embodiment of the present invention.
Figure 10:
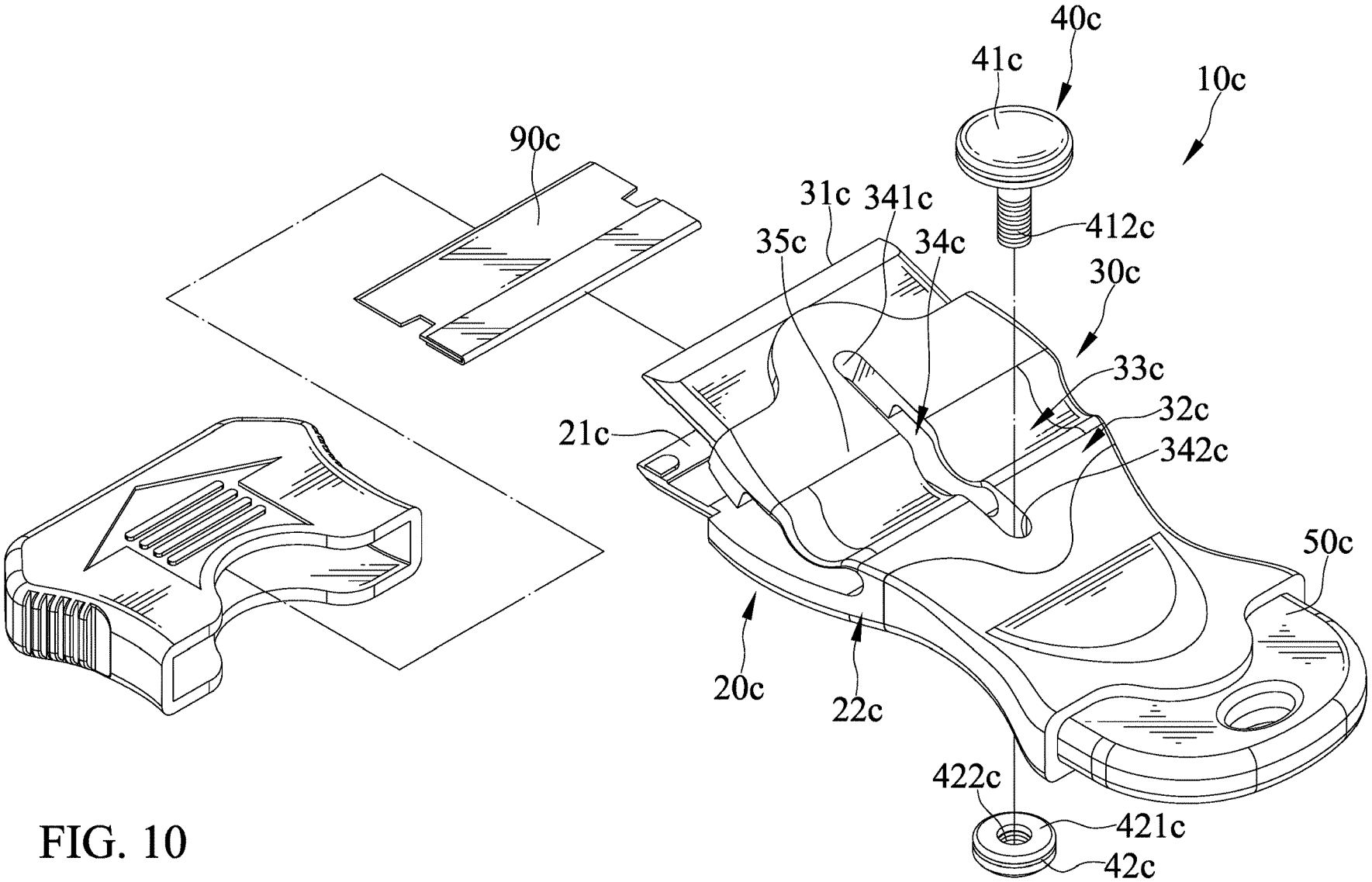
FIG. 10 is an exploded perspective view of the blade changeable knife of FIG. 9.

FIGS. 1 through 4 show a blade changeable knife 10*a* in accordance with a first embodiment of the present invention.

The blade changeable knife 10*a* has a holding member 20*a* and a holding member 30*a* configured to hold a blade 90*a*.

The holding member 20*a* has a holding portion 21*a* and a connecting portion 22*a*.

The holding member 30*a* is made in two pieces, which has a first holding component and a second holding component integrated with the first holding component. The second holding component is disposed between the first holding component and the holding member 20*a*. The first holding component defines a slot 36*a*. The second component forms a holding portion 31*a* and a connecting portion 32*a* of the holding member 30*a*. The connecting portion 32*a* is disposed on and connected with the connecting portion 22*a*. The holding portion 31*a* and the connecting portion 32*a* are interconnected by a flexible portion 33*a* such that the holding portion 31*a* is adapted to be flexed with respect to the connecting portion 32*a*.

The holding member 30*a* is adapted to be flexed. Specifically, the holding member 30*a* includes the first holding component being flexible such that the first holding portion 31*a* adapted to be flexed to a holding position in which the holding portions 21*a* and 31*a* are disposed close to each other and include a space therebetween for receiving the blade 90*a* and a releasing position in which the holding portions 21*a* and 31*a* are disposed apart from each other. The flexible portion 33*a* extends curvedly longitudinally. The flexible portion 33*a* is thinner than the holding portion and the connecting portion.

Further, the blade changeable knife 10*a* has a locking device. The locking device has a lock 41*a* movably engaged with the holding member 30*a*. The lock 41*a* is movably engaged in the slot 36*a*. The lock 41*a* is selectively disposed on the second holding portion 31*a* and the second connecting portion 32*a*. When the holding member 30*a* is in the holding position, the lock 41*a* abuts the holding member 30*a*, is located at a first position, and is disposed on the holding portion 31*a*. When the holding member 30*a* is in the releasing position, the lock 41*a* abuts the holding member 30*a*, is located at a second position further away from the holding portion 31*a* than when in the first position, and is disposed on the connecting portion 32*a*.

In this embodiment, there is no groove with which the lock 41*a* engages.

FIGS. 5 through 8 show a blade changeable knife 10*b* in accordance with a second embodiment of the present invention, and the same numbers are used to correlate similar components of the first embodiment, but bearing a letter b. The blade changeable knife 10*b* has a holding member 20*b* and a holding member 30*b*.

The holding member 20*b* differentiates from the holding member 20*a* in that the holding member 20*b* defines a groove 23*b*.

The holding member 30*b* has a holding portion and a connecting portion interconnected by a flexible portion 33*b*. The flexible portion 33*b* extends curvedly longitudinally. The flexible portion 33*b* is thinner than the holding portion and the connecting portion. The holding member 30*b* is made in two pieces, which has a first holding component and a second holding component integrated with the first holding component. The first holding component defines a slot 36*b*. The holding member 30*b* differentiates from the holding member 30*a* in that the holding member 30*b* defines a groove 34*b*. The groove 34*b* is defined in the second holding component. The second holding component is held between the first holding component and the holding member 20*b*.

Further, the blade changeable knife 10*b* has a locking device. The locking device has a lock 41*b* movably engaged in the groove 34*b*. The locking device has a fastener engaged with the lock 41*b*. The lock 41*b* has an engaging portion movably engaged in the groove 34*b* and the groove 23*b*. The engaging portion has an end disposed outside of the second groove 23*b* and engaged with the fastener. The lock 41*b* is movably engaged in the slot 36*b*.

FIGS. 9 through 12 show a blade changeable knife in accordance with a third embodiment of the present invention, and the same numbers are used to correlate similar components of the first embodiment, but bearing a letter c. The holding member 20*c* has a holding portion 21*c* and a connecting portion 22*c*. The holding member 20*c* defines a groove 23*c*. The groove 23*c* has an end 231*c* and an end 232*c*.

The holding member 30*c* has a holding portion 31*c* and a connecting portion 32*c*. The holding member 30*c* is formed in one piece. The holding portion 31*c* and the holding portion 21*c* are disposed oppositely and configured to hold the blade 90*c* therebetween. The connecting portion 32*c* is disposed on and connected with the connecting portion 22*c*. The holding portion 31*c* and the connecting portion 32*c* are interconnected by a flexible portion 33*c* such that the holding portion 31*c* is adapted to be flexed with respect to the connecting portion 32*c*. The holding member 30*c* is adapted to be flexed to a holding position in which the holding portions 21*c* and 31*c* are disposed close to each other and include a space therebetween for receiving the blade 90*c* and a releasing position in which the holding portions 21*c* and 31*c* are disposed apart from each other. The flexible portion 33*c* extends curvedly longitudinally. The flexible portion 33*c* is thinner than the holding portion 31*c* and the connecting portion 32*c*. The holding member 30*c* defines a groove 34*c*. The groove 34*c* extends longitudinally in the holding portion 31*c* and the flexible portion 33*c*.

Further, a locking device 40*c* has a lock 41*c* movably engaged with the holding member 30*c*. The lock 41*c* is selectively disposed on the holding portion 31*c* and the connecting portion 32*c*. When the holding member 30*c* is in the holding position, the lock 41*c* abuts the holding member 30*c*, is located at a first position, and is disposed on the holding portion 31*c*. The lock 41*c* has an abutting portion 411*c* movably disposed on an outer surface 35*c* of the holding member 30*c*. When the holding member 30*c* is in the releasing position, the lock 41*c* abuts the holding member 30*c*, is located at a second position further away from the holding portion 31*c* than when in the first position, and is disposed on the connecting portion 32*c*. The lock 41*c* is movably engaged in the groove 34*c*. The locking device 40*c* has a fastener 42*c* engaged with the lock 41*c*. The groove 34*c* has an end 341*c* defined in the holding portion 31*c*, a middle defined in the flexible portion 33*c*, and an end 342*c* defined in the connecting portion 32*c* respectively. The lock 41*c* has an engaging portion 412*c* movably engaged in the grooves 34*c* and 23*c*. The engaging portion 412*c* has an end disposed outside of the groove 23*c* and engaged with the fastener 42*c*. The fastener 42*c* has an engaging portion 422*c*. The lock 41*c* includes the engaging portion 412*c* thereof engaged with the engaging portion 422*c* of the fastener 42*c*. The lock 41*c* and the fastener 42*c* are in thread engagement. The fastener 42*c* has an abutting portion 421*c* movably disposed on an outer surface 24*c* of the holding member 20*c*.

Figure 11:
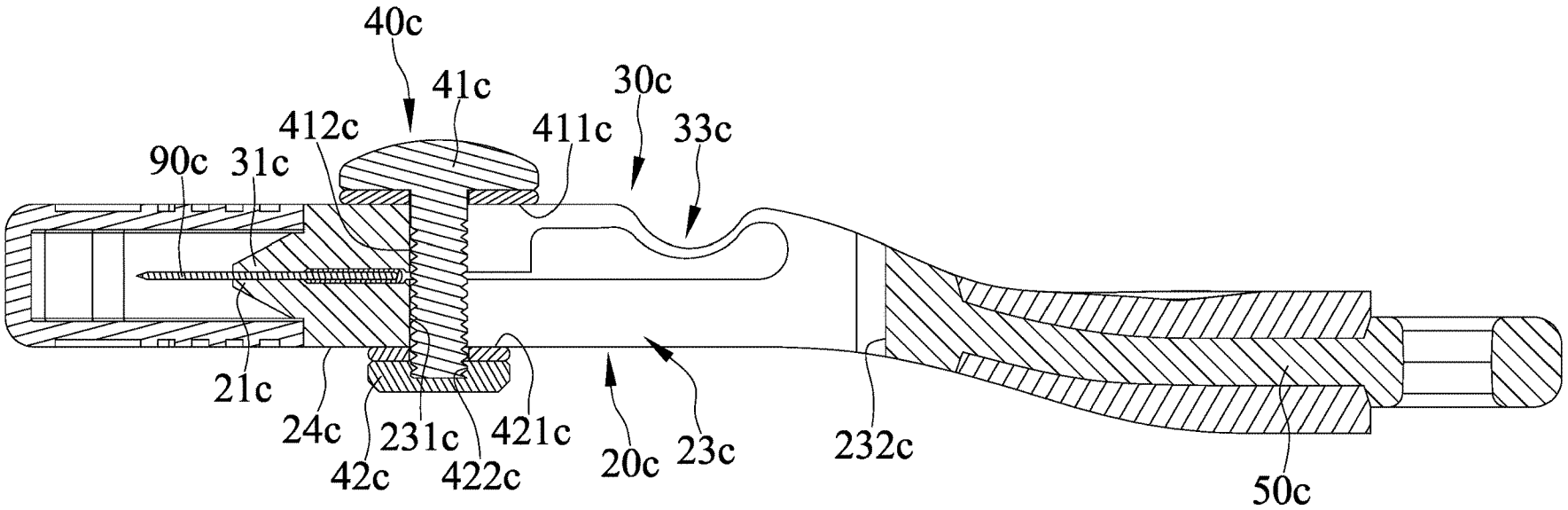
FIG. 11 is a cross-sectional view of the blade changeable knife of FIG. 9 in a blade locked position.

FIG. 11 shows the blade changeable knife 10*c* in a blade locked position in which the holding member 30*c* is in the holding position and the lock 41*c* is located at the first position. When the holding member 30*c* is in the holding position, the lock 41*c* is located adjacent to the end 341*c* of the groove 34*c* and the end 231*c* of the groove 23*c*.

Figure 12:
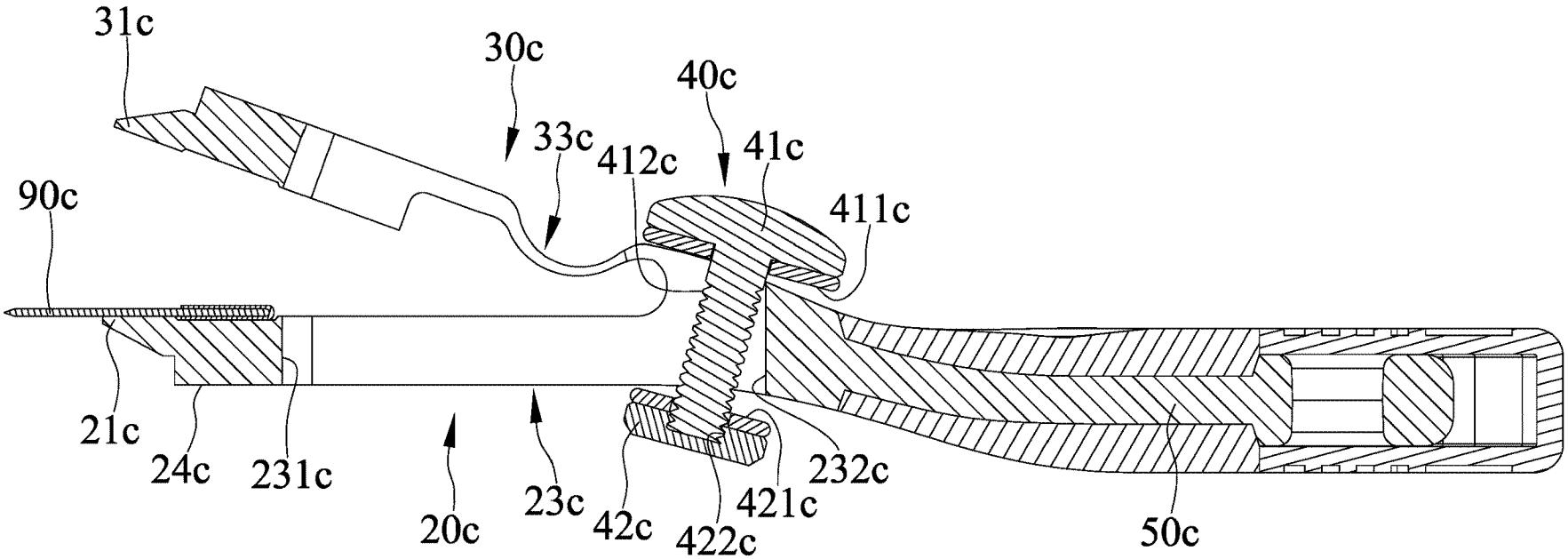
FIG. 12 is a cross-sectional view of the blade changeable knife of FIG. 9 in a blade unlocked position.

FIG. 12 shows the blade changeable knife 10*c* in a blade unlocked position in which the holding member 30*c* is in the releasing position and the lock 41*c* is located at the second position. When the holding portions 21*c* and 31*c* are disposed apart from each other, a user can replace the blade 90*c*. Further, since the holding portion 31*c* is adapted to be flexed with respect to the connecting portion 32*c*, the holding portion 31*c* can be moved further apart from the holding portion 21*c* to enable the user to replace the blade 90*c* conveniently. When the holding member 30*c* is in the releasing position, the lock 41*c* is located adjacent to the ends 342*c* of the groove 34*c* and the end 232*c* of the groove 23*c*.

The blade changeable knife 10*c* also has a grip portion 50*c*. A user can hold on the grip portion 50*c* when operating the blade changeable knife 10*c*. The connecting portions 22*c* and 32*c* of the holding members 20*c* and 30*c* are connected between the holding portions 21*c* and 31*c* of the holding members 20*c* and 30*c* and the grip portion 50*c*. The holding members 20*c* and 30*c* and the grip portion 50*c* are formed in one piece. The holding members 20*c* and 30*c* and the grip portion 50*c* are molded in one piece.

In view of the forgoing, the locking device 40*c* can be easily operated. Further, the holding portions 21*a*, 21*c*, 31*a*, and 31*c* can move away from each other to an extent that a user can replace the blades 90*a* and 90*c* conveniently when the locking device 40*c* is moved to the unlocking position.

The foregoing is merely illustrative of the principles of this invention and various modifications can be made by those skilled in the art without departing from the scope and spirit of the invention.

What is claimed is:

1. A blade changeable knife comprising:

a first holding member having a first holding portion and a first connecting portion;

a second holding member having a second holding portion, a second connecting portion, a flexible portion extending from the second connecting portion to the second holding portion such that the second holding portion is adapted to be flexed with respect to the second connecting portion, wherein the flexible portion is thinner than the second holding portion, wherein the second connecting portion is disposed on and connected with the first connecting portion, wherein the second holding portion and the first holding portion are disposed oppositely and configured to hold a blade therebetween, and wherein the second holding portion of the second holding member is adapted to be flexed to a holding position in which the first and the second holding portions are disposed close to each other and include a space therebetween for receiving the blade and a releasing position in which the first and the second holding portions are disposed apart from each other; and a locking device having a lock movably engaged with the second holding member, wherein when the second holding portion of the second holding member is in the holding position, the lock abuts the second holding portion of the second holding member, and wherein when the second holding member is in the releasing position, the lock abuts the second holding member and located away from the second holding portion.

2. The blade changeable knife as claimed in claim 1, wherein the lock is selectively disposed on the second holding portion and the second connecting portion, wherein when the second holding member is in the holding position, the lock is disposed on the second holding portion, and wherein when the second holding member is in the releasing position, the lock is disposed on the second connecting portion.

3. The blade changeable knife as claimed in claim 1, wherein the flexible portion extends curvedly longitudinally.

4. The blade changeable knife as claimed in claim 3, wherein the flexible portion is thinner than the second connecting portion.

5. The blade changeable knife as claimed in claim 1, wherein the second holding member are formed in one piece.

6. The blade changeable knife as claimed in claim 5 further includes a grip portion, wherein the first and the second connecting portions of the first and the second holding members are connected between the first and the second holding portions of the first and the second holding members and the grip portion, and wherein the first and the second holding members and the grip portion are formed in one piece.

7. The blade changeable knife as claimed in claim 5, wherein the flexible portion extends curvedly longitudinally.

8. The blade changeable knife as claimed in claim 7, wherein the flexible portion is thinner than the second holding portion and the second connecting portion.

9. The blade changeable knife as claimed in claim 1, wherein the second holding member defines a first groove, and wherein the lock is movably engaged in the first groove.

10. The blade changeable knife as claimed in claim 9, wherein the first holding member defines a second groove, wherein the locking device has a fastener engaged with the lock, wherein the lock has a first engaging portion movably engaged in the first groove and the second groove, wherein the first engaging portion has an end disposed outside of the second groove and engaged with the fastener.

11. The blade changeable knife as claimed in claim 10, wherein the first groove extends longitudinally in the second holding portion and the flexible portion.

12. The blade changeable knife as claimed in claim 9, wherein the second holding member is formed in one piece.

13. The blade changeable knife as claimed in claim 9, wherein the second holding member is made in two pieces, which has a first holding component and a second holding component integrated with the first holding component, wherein the first holding component defines a slot and the lock is movably engaged in the slot, wherein the first groove is defined in the second holding component, and wherein the second holding component is disposed between the first holding component and the first holding member.

14. The blade changeable knife as claimed in claim 1, wherein the second holding member is made in two pieces, which has a first holding component and a second holding component integrated with the first holding component, wherein the first holding component defines a slot and the lock is movably engaged in the slot, and wherein the second holding component is disposed between the first holding component and the first holding member.

15. The blade changeable knife as claimed in claim 14, wherein the flexible portion extends curvedly longitudinally.

16. The blade changeable knife as claimed in claim 15, wherein the flexible portion is thinner than the second connecting portion.

* * * * *